US005443439A

United States Patent [19]

Ohshita

[11] Patent Number: 5,443,439

[45] Date of Patent: Aug. 22, 1995

[54] BED APPARATUS AND METHOD FOR DRIVING A BEDSTEAD

[75] Inventor: Shoji Ohshita, Miyoshi, Japan

[73] Assignee: France Bed Co., Ltd., Tokyo, Japan

[21] Appl. No.: 46,522

[22] Filed: Apr. 13, 1993

[30] Foreign Application Priority Data

Apr. 21, 1992 [JP] Japan ..... 4-101329

[51] Int. Cl.[6] ..... A61H 1/00

[52] U.S. Cl. ..... 601/90; 5/613; 5/933; 601/26; 601/98

[58] Field of Search ..... 601/5, 23, 24, 26, 29, 601/31, 42, 89, 90, 86, 49, 50, 53, 57, 100, 101; 5/613, 600, 933, 934

[56] References Cited

U.S. PATENT DOCUMENTS 2,893,380 7/1959 Walker ..... 601/24
3,811,430 5/1974 Kawakami ..... 601/57
3,881,469 5/1975 Kanemitsu ..... 601/24
4,225,988 10/1980 Cary et al. .
4,469,093 9/1984 Chaplar .
4,999,861 3/1991 Huang ..... 5/600
5,092,315 3/1992 Bennett ..... 601/101
5,258,019 11/1993 Riddle ..... 601/24

FOREIGN PATENT DOCUMENTS 1041636 10/1953 France .
522814 4/1931 Germany .

*Primary Examiner*—Mickey Yu
*Assistant Examiner*—David J. Kenealy
*Attorney, Agent, or Firm*—Frishauf, Holtz, Goodman, Langer & Chick

[57] ABSTRACT

A bedstead mounted on a bedframe is divided into a plurality of separation pieces. The separation pieces are set swingable on the bedframe. A drive shaft is provided on the bedframe. The drive shaft is rotationally; driven by a driver. The rotational motion of the drive shaft is converted by a power transmitting device to an up and down motion whereby the separation pieces are so driven as to be swingable over the bedframe.

17 Claims, 16 Drawing Sheets

BED APPARATUS AND METHOD FOR DRIVING A BEDSTEAD

BACKGROUND OF THE INVENTION

1. Field of the Invention

The present invention relates to a bed apparatus utilized to maintain the body of a user to be in a good and healthy position and to a method for driving its bedstead.

2. Description of the Related Art

Generally, a bed apparatus is utilized to lie on a mattress for sleep. In order to provide added value, various functions are imparted to the bed apparatus.

Recently, various bed apparatuses have aroused the user's attention for slimming and healthy exercise and they are placed on the market. In order to maintain the user's body slim and healthy it is required that adequate exercise be given to him and her in a lying position on a mattress so as to eliminate any excess build-up of fat in the body.

Adequate exercise ensures better blood circulation and excellent health. For the bed-ridden elderly and sick for instance it is possible to enjoy body exercise and thus to regain various functions of the body through the exercise. Further such bed apparatuses are utilized to, for example, induce sleep in the user by providing a comfortable rocking mode and to rouse the user from sleep with a strong, disturbing mode.

The user, if being rocked on the mattress to the right and left, can be given a roll-over movement. For the sick and elderly bed-ridden for a long period of time it is possible to prevent bedsores by providing a roll-over motion on the mattress at an adequately slow speed.

It is very convenient for the user to be given healthy and slimming exercise or body-function improving exercise on the mattress or to enjoy such exercise on the mattress of the present bed apparatus.

SUMMARY OF THE INVENTION

It is accordingly the object of the present invention to provide a bed apparatus and a method for driving a bedstead which enable a user to simply sleep a comfortable sleep or to be given, or enjoy, slimming exercise for health and aesthetic purposes.

In a preferred aspect of the present invention a bed apparatus is provided which comprises a bedframe; a bedstead divided into a plurality of separation pieces, the separation pieces being swingable or rockable; a drive shaft rotatably mounted on the bedframe; and power transmitting means for converting rotation motion of the drive shaft to an up and down motion and for swinging the separation pieces of the bedstead by the up/down motion.

In the invention as claimed in claim 15, a bed apparatus is provided which comprises a bedframe, a bedstead divided into a plurality of separation pieces and swingably mounted on the bedframe in a given array, drive means for swingably driving the separation pieces for each of groups into which the separation pieces are grouped and control means for controlling the swinging drive of the separation pieces for each group.

According to the bed apparatus as claimed in claim 1, the separation pieces constituting a bedstead are swingably driven to impart swinging motion to the user and can be controlled in their swing motion phase so that various extents and kinds of exercise can be given to the user.

According to the bed apparatus as claimed in claim 15, the swinging or rocking of the separation pieces can be controlled for each group so that their swing motion pattern can be set for each group of the separation pieces.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

The embodiment of the present invention will be explained below with reference to the accompanying drawings.

Figure 1:
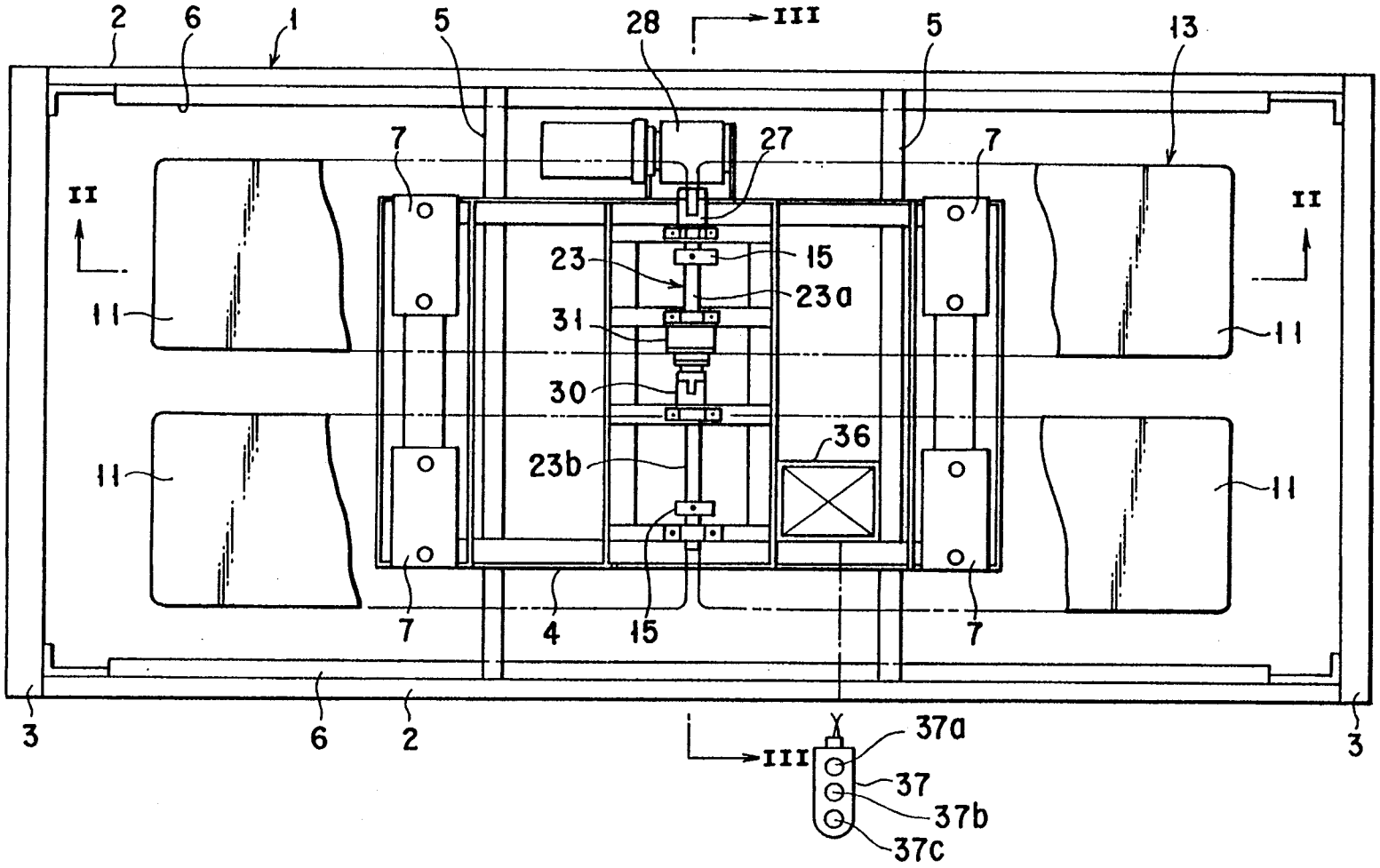
FIG. 1 is a plan view showing a bed apparatus according to a first embodiment of the present invention.
Figure 2:
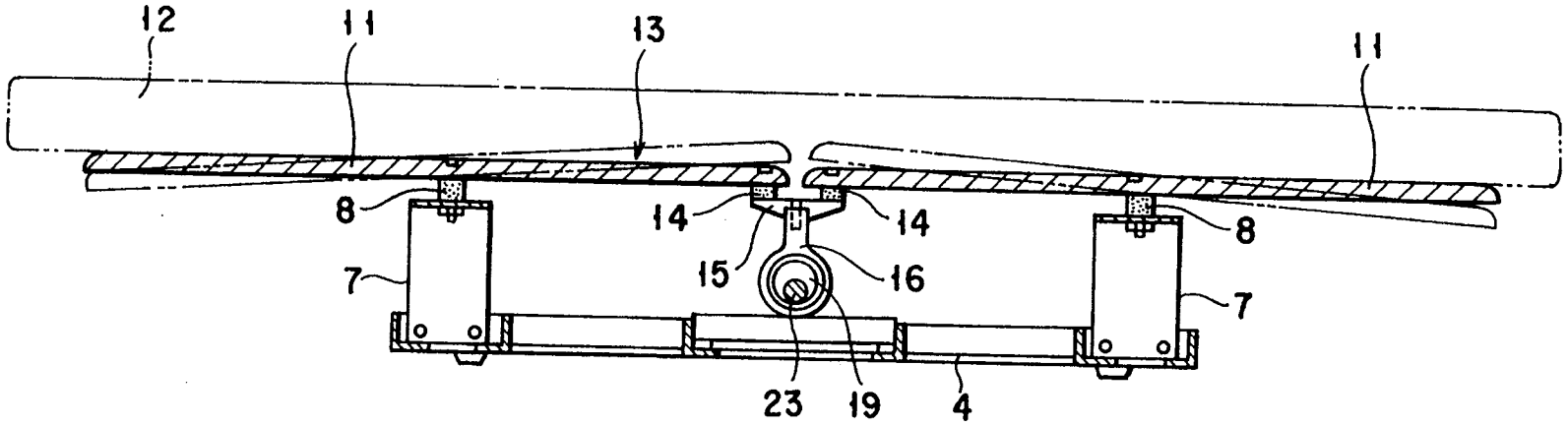
FIG. 2 is a cross-sectional view taken along line II—II in FIG. 1.
Figure 3:
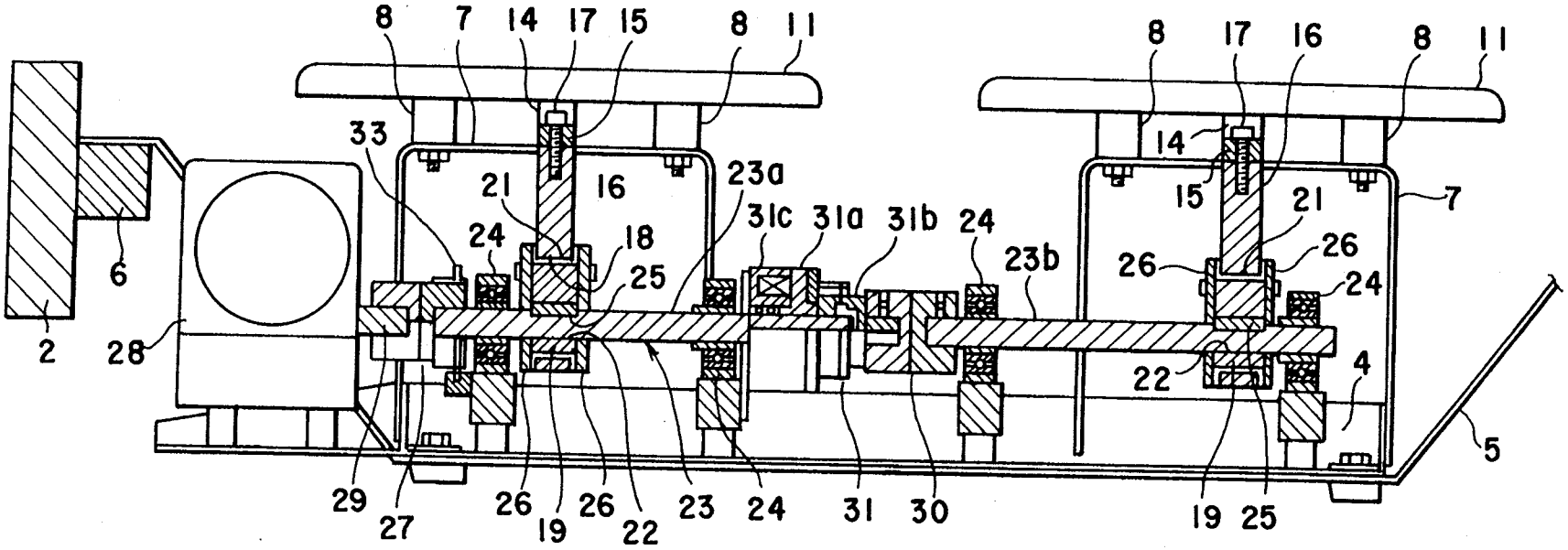
FIG. 3 is a cross-sectional view taken along line III—III in FIG. 1.

FIGS. 1 to 9 show a first embodiment of the present invention. A bed apparatus as shown in FIG. 1 includes a rectangular bedframe 1 having a pair of side plates 2 and a pair of end plates 3. A base member 4 is arranged inside the bedframe 1 and is formed of a small rectangular frame-like member. The base member 4 is coupled to the bedframe 1 by a pair of joint bars 5 arranged along a width direction of the bedframe. The joint bar 5 is comprised of a band-like member with each end portion upwardly bent and fixed to a corresponding rail 6, as shown in FIG. 3, provided on the inner surface of the side plate 2. The joint bar is coupled at its middle portion to the base member 4.

Four support members 7 are uprightly arranged one at each corner area of the rectangular base member 4 along the width direction of the bedframe 1. A pair of coupling members 8 is provided at an upper end area of each support member 7 along a III—III direction of FIG. 1 and each comprised of an elastic member 8*a* (of FIG. 7), such as rubber, serving as a support member and a pair of bolts 8*b* having their head portions buried in the elastic member 8*a* and their threaded portions projected out of the corresponding ends of the elastic member 8*a*. One of the pair of bolts is fixed by nut 9 to the surface of the support member 7 and slender, rectangular, plate-like separation pieces 11, 11 are each fixed by another nut 9 and another bolt 8*b* of the coupling member 8 at an intermediate area of the length of the separation piece whereby the separation piece 11 is swingably mounted about its intermediate area.

The separation piece 11 is coupled to the upper surface of the four support members 7. In this way, the two separation pieces 11 are arranged in two arrays in a longitudinal direction of the bed frame 1 and a bendable mattress 12 is disposed over the upper surface of the separation pieces 11 as indicated by a dash-dot line in FIG. 2. In this embodiment, a bedstead 13 over which the mattress 12 is disposed is comprised of the four separation pieces 11.

As shown in FIG. 2, coupling members 14 similar in structure to the coupling members 8 have their one-end side fixed to the lower surfaces of the middle areas of mutually adjacent end portions of the separation pieces 11 as viewed in a width direction as shown in FIG. 2. The other-end side of the coupling member 14 is fixed to a single coupling tool 15.

Those adjacent separation pieces 11, at each array, coupled by the coupling tool 15 are swingable about that area, while elastically deforming the coupling member 14, which is coupled to the support member 7 by the coupling member 8.

Figure 4:
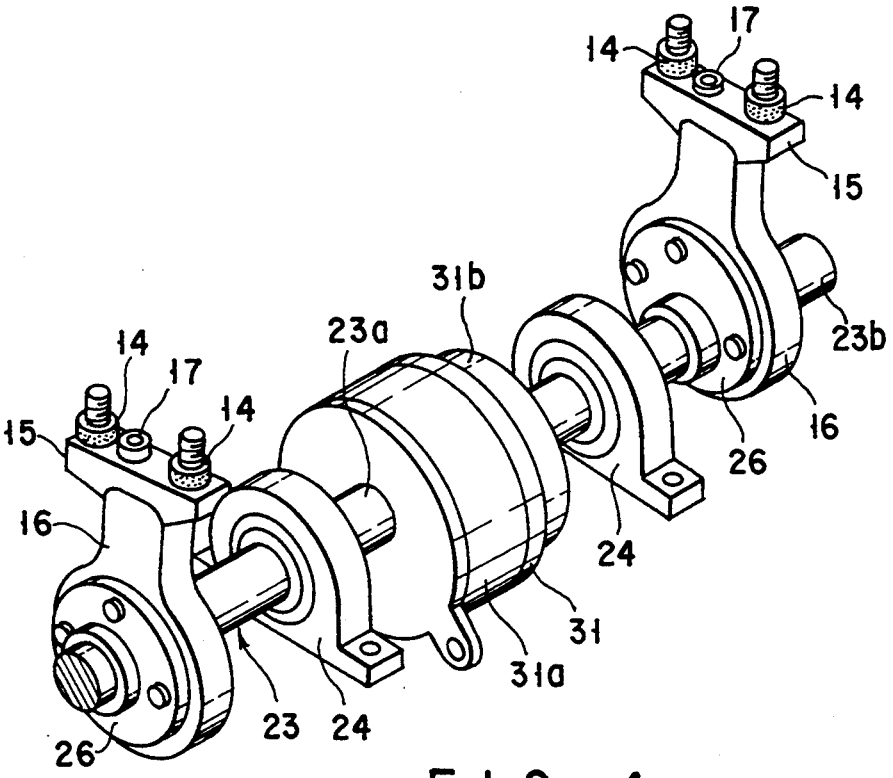
FIG. 4 is a perspective view showing a drive mechanism for swingably driving separation pieces in a bedstead.

As shown in FIGS. 3 and 4, the coupling tool 15 is fixedly coupled by a corresponding bolt 17 to the upper end face of a corresponding movable arm 16 constituting a power drive means. A mount hole 18 is provided at a lower-end side of the movable arm 16 and a circular disk 19 is rotatably mounted in the mount hole 18 through a dry bearing 21. An eccentric hole 22 is provided in an eccentric relation to the rotation center of the disk 19.

A drive shaft 23 extends through those eccentric holes 22 of the disks 19 of those paired movable arms 16 arranged along the width direction of the bedframe 1. The drive shaft 23 is divided into a drive shaft section 23*a* and driven shaft section 23*b*. The drive shaft section 23*a* and driven shaft section 23*b* are arranged in an aligned relation and rotatably journalled in associated bearings 24.

An intermediate portion of the drive shaft section 23*a* passed through the eccentric hole 22 is nonrotatably coupled by a key 25 to one disk 19 and an intermediate portion of the driven shaft section 23*b* is coupled by a key 25 to the other disk 19. In order to prevent the disk 19 from being detached from the mount hole 18 a pair of pressing plates 26 larger in diameter than the mount hole 18 are fixed relative to the corresponding disk 19.

The drive shaft section 23*a* of the drive shaft 23 is connected at one end to an output shaft 29 of a drive source 28 by a first coupling 27 and at the other end to a rotor side 31*a* of an electromagnetic clutch 31. One end of the driven shaft section 21*b* of the drive shaft 23 is coupled by a second coupling 30 to the armature side 31*b* of the electromagnetic clutch 31. The rotor side 31*a* and armature side 31*b* are held in a field 31*c* corresponding to a stationary section.

Figure 8:
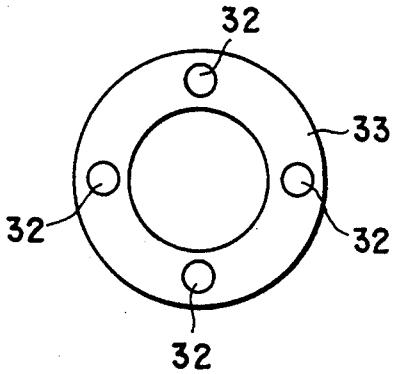
FIG. 8 is a side view showing a slit plate for controlling the swing motion phase of the separation pieces.
Figure 9:
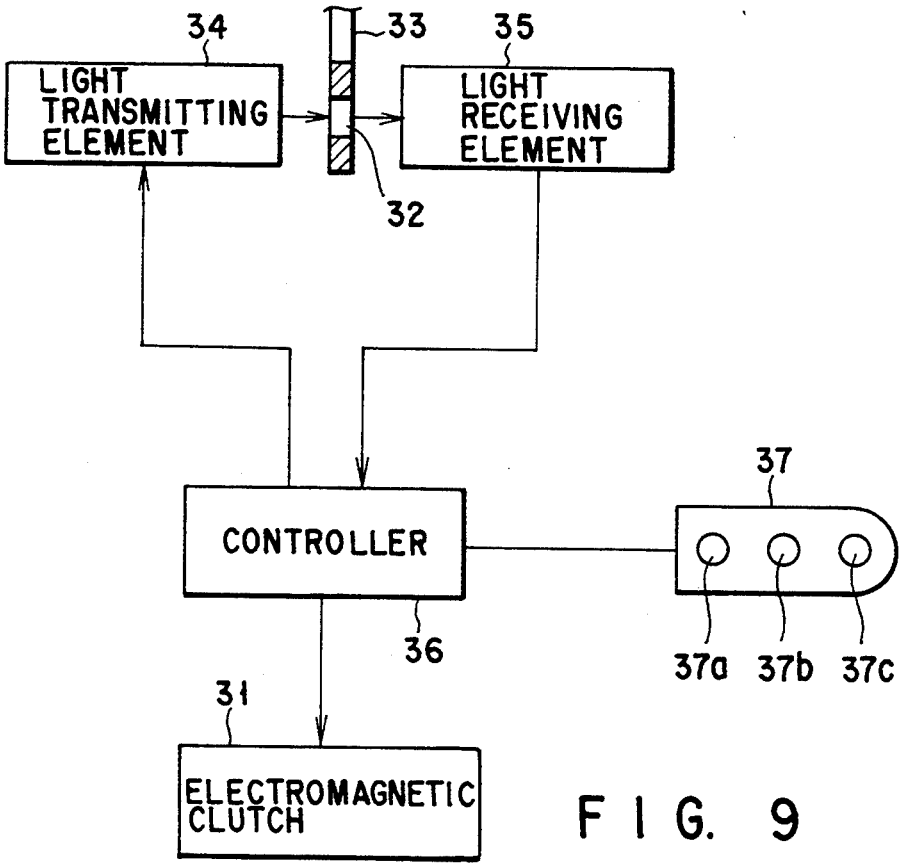
FIG. 9 is a circuit diagram for controlling swing motion of the separation pieces.

A disk-like slit plate 33 is mounted on one-end side of the drive shaft section 23*a* of the drive shaft 23 and has four through-holes 32 at intervals of 90° in a circumferential direction as shown in FIG. 8. A light transmitting element 34, such as a light emitting diode, is disposed on one surface side and a light receiving element 35, such as a phototransistor, is disposed on the other surface side of the slit plate 33 in an opposed relation to the element 34 as shown in FIG. 9.

The light transmitting element 34 emits light upon receipt of a drive signal coming from a controller 36 disposed on the base member 4 and the light receiving element 35 delivers, to the controller 36, a detection signal involved upon receipt of light from the light transmitting element 34 via the through-hole 32 in the slit plate 33. An operator-side operation section 37 is connected to the controller 36 and the electromagnetic clutch as set out above is electrically connected to the controller 31 so as to be controlled, as set out above, in accordance with a detection signal coming from the light receiving element 35.

A power source switch 37*a*, operation switch 37*b* and speed control switch 36*c* are provided in the operator-side operation section 37. With the power source switch 37*a* in an ON state, electric power is fed to the drive source 28, electromagnetic clutch 31 and light transmitting element 34. The operation of the drive source 28 leads to the rotational drive of the drive shaft 23. The rotation of the drive shaft 23 causes the eccentric rotation of the disk 19 eccentrically fitted over the drive and driven shaft sections 23*a* and 23*b*, resulting in an up and down movement of the paired movable arms 16 due to the eccentric rotation.

The coupling tool 15 as set out above is provided on the upper end of the respective movable arm 16 and coupled by the coupling members 14 to the adjacent ends of the paired separation pieces 11 arranged in the longitudinal direction of the bedframe 1. The up/down movement of the movable arm 16 causes the adjacent end portions of the paired separation pieces 11 to be moved in the up and down direction or in push/pull motion and hence the paired separation pieces 11, while being bent to a varying extent, swingably moves the coupling member 8 which is mounted on the upper end of the support member 7.

The swinging movement of the respective paired separation pieces 11 along the width direction of the bedframe 1, that is, the swinging movement of the separation pieces 11 in the one array and in the other can be subjected to phase control. In order to make such phase control, the operation switch 37*b* on the operator-side operation switch 37*b* is switched ON and the carrying of electric current into the electromagnetic clutch 31 is interrupted by a signal from the light transmitting element 34 via the though-hole 32 in the slit plate 33 which is first detected by the light receiving element 35. In other words, the driven shaft section 23*b* of the drive shaft 23 is separated from the drive shaft section 23*a* whereby the drive shaft section 23*a* alone is rotated by the drive source 28.

After being separated from the drive shaft section 23*a* the driven shaft section 23*b* is not rotated by an inertial force because a load is borne on the driven shaft section 23*b*.

The rotational drive of the drive shaft section 23*a* alone swingably moves only one array of separation pieces 11 along the width direction of the bedframe 1. When the light receiving element 35 detects the next light from the light transmitting element 34, that is, when the slit plat 33 is rotated through an angle of 90° and light receiving element receives that light via the next adjacent through-hole 32 corresponding to the 90° rotation of the slit plate 33, electric power is supplied by a corresponding detected signal to the electromagnetic clutch 31 so that the drive and driven shaft sections 23*a* and 23*b* of the drive shaft 23 are connected to each other. As a result, the separation pieces 11 in the other array restart swinging movement, along the width direction of the bedframe 1, in a 90° phase delayed relation to the one-array side separation pieces 11. In other words, the separation pieces 11 on the one array side and those on the other array side can be swung, along the width direction of the bedframe 1, in a sequential 90° phase shift relation by switching the operation switch 37*b* ON at a time.

Put it in more detail, if the operation switch 27*b* is switched ON when the paired left and right separation pieces 11 are swung in the same phase, that is, in the same state, the phase with which the paired right and left separation pieces 11 are swung can be 90° delayed. If in this state the operation switch 27*b* is again switched ON, then the phase as set out above can be delayed by another 90° , that is, a 180° phase shift is achieved from the initial state so that it is possible to reverse the upward and downward swinging movements of the paired right and left separation pieces 11. To be specific, the paired separation pieces 11 in the right and left arrays can be controlled in three phase steps of 0°, 90° and 180° in swinging motion.

When the speed control switch 37*c* of the operation section 37 is rotationally operated, then the rotation rate of the drive shaft 23 by the drive source 28 is steplessly controlled and it is possible to adjust the speed with which the paired separation pieces 11 are swung.

Figure 5:
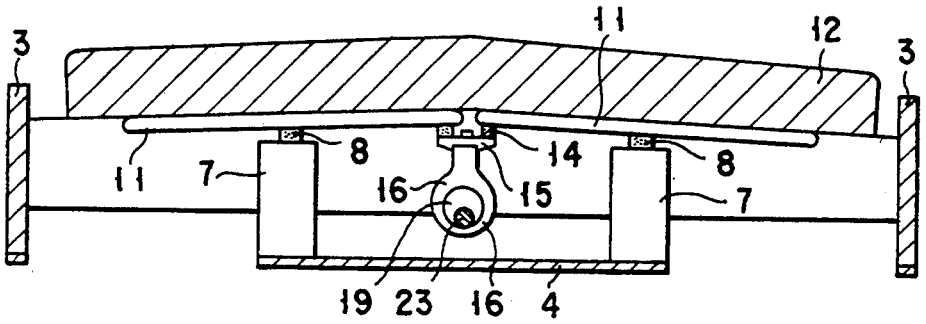
FIG. 5 is a cross-sectional view showing a mattress bent at a middle area in its longitudinal direction.

According to the bed apparatus thus arranged, the user can operate the drive source 28 in a lying-on-the-back position so that the drive shaft 23 is rotated by the drive source 28. If, by so doing, the paired right and left separation pieces 11 are swung, for example, with the same phase, then the mattress 12 is bent at a middle area along the longitudinal direction as shown in FIG. 5 so that the waist of the user's body can repeatedly be bent. It is thus possible to do slimming exercise for health so that any excess deposition of fat in the waist can be eliminated.

Figure 6:
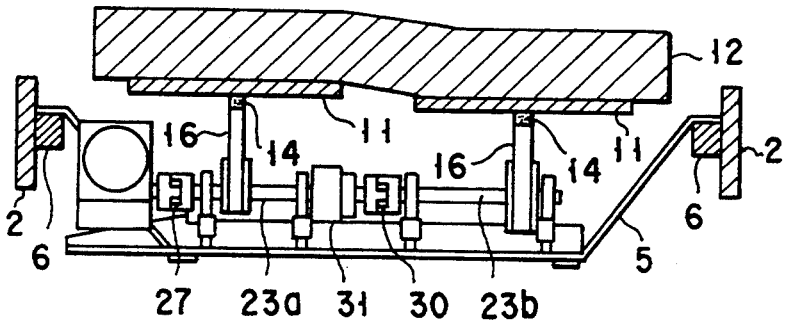
FIG. 6 is a cross-sectional view showing a mattress bent in a width direction.
Figure 7:
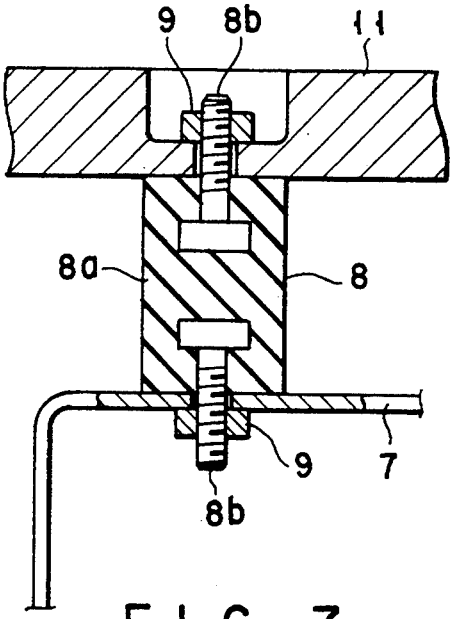
FIG. 7 is a cross-sectional view showing a coupling mechanism for a support member and a separation piece of a bedstead.

In case where the phase with which the right and left separation pieces 11 are swung is varied through an angle of 90° for instance, the mattress 12 is bent not only at a middle area in the longitudinal direction but also at a middle area in the width direction in up/down motion, that is, in the right and left directions as shown in FIG. 6. To be specific, the mattress 12 is twisted in the width direction. The extent of the twist motion is adjusted in a phase shift range of 0° to 180° where there is no twist for 0° and a maximum twist for 180°.

In other words, the swinging movement of the paired separation pieces 11 in the one array side as caused by the drive shaft section 23*a* follows that of the paired separation pieces 11 in the other array side as caused by the driven shaft section 23*b*. A twist is given to the mattress upon the alternation of the upward and downward swinging motions of the two paired arrays.

In accordance with these motions the body of the user is given right/left twist motion when being bent at the waist area. It is possible to impart adequate exercise to the user with a greater effect than in the case where the paired right and left separation pieces 11 have the same swing phase position.

If the rotation speed of the drive shaft 23 is delayed by the speed control switch 37*c* the body of the user, while swaying just as in a cradle, can be given adequate rest in a comfortable state. Further, the user can enjoy roll-over motion in a bed in right/left motion. For the user, such as the sick and elderly bed-ridden for a long period of time it is possible to experience the aforementioned roll-over motion on the mattress at a slow rate of speed and to prevent a possible bedsore.

The swing phase of the paired right and left separation pieces 11, being shifted by another 90°, that is, being shifted to 180°, enables greater lateral twist motion (roll-over motion) to be imparted to the user than in the case of the phase being 90°. It is, therefore, possible to give adequate exercise to the user effectively.

To be specific, the user can select the kind, extent, etc., of exercise when occasion arises.

The second to ninth embodiments of the present invention will now be explained below. In these embodiments the same reference numeral is employed to designate parts or elements corresponding to those shown in the first embodiment of the present invention.

Figure 10:
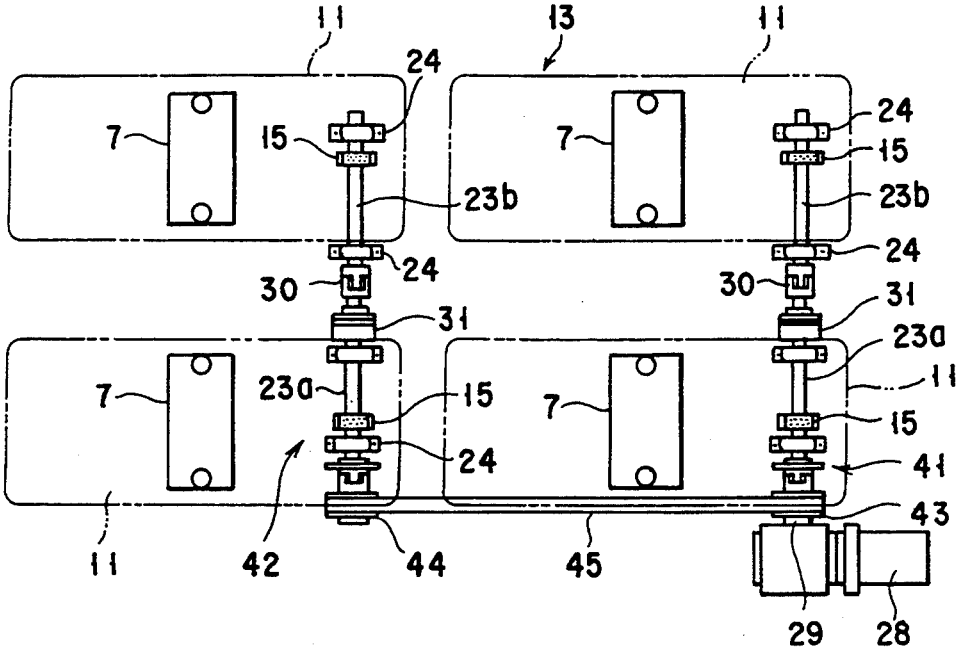
FIG. 10 is a plan view showing a second embodiment of the present invention.
Figure 11:
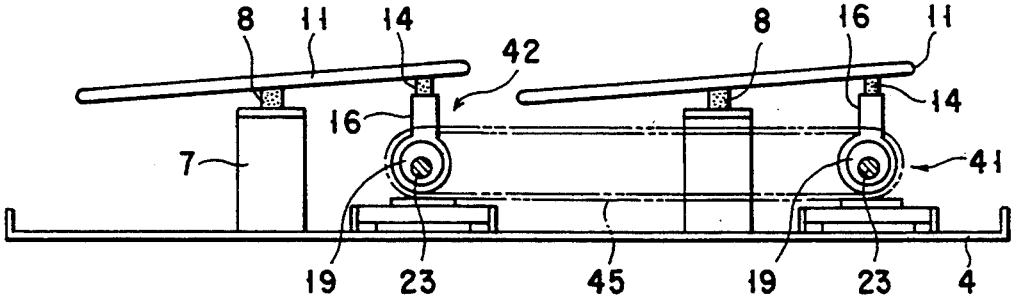
FIG. 11 is a side view showing the second embodiment.

FIGS. 10 and 11 show a second embodiment of the present invention. The second embodiment of the present invention is similar to the first embodiment except that a bedstead 13 is comprised of four separation pieces 11, but is different from the first embodiment in that it is possible to control a swing phase for a pair of separation pieces 11, right and left, on one-end side and pair of separation pieces 11, right and left, on the other-end side of a length of bedframe 1.

To be specific, a first drive mechanism 41 is arranged on one-end side of the length of the bedframe 1 and a second drive mechanism 42 is arranged somewhat more to the other-end side than at a middle. The drive mechanisms 41 and 42 each comprise a drive shaft 23 divided into a drive shaft section 23*a* and driven shaft section 23*b* disconnectable by an electromagnetic clutch 31 from each other and a pair of movable arms 16 driven in an up and down motion by the rotation of the drive shaft 23.

The drive shaft section 23*a* of the first drive mechanism 41 is connected to an output shaft 29 of a drive source 28. A drive pulley 43 is fitted over the output shaft 29 and a driven pulley 44 is fitted over one end portion of a drive shaft section 23*a* of the second drive mechanism 42. A belt 45 is run between the pulleys 43 and 44. The first drive mechanism 41 is driven directly by the drive source 28 and the second drive mechanism 42 is of such a type that drive power from a drive source 28 is transmitted by the belt 45.

It is to be noted that the electromagnetic clutch 31 of the respective drive mechanisms 41 and 42 can be controlled through a controller 36 and operator-side operation section 37 as in the case of the first embodiment.

According to the second embodiment thus arranged, the paired separation pieces 11 in the one array situated on one end side of the bedframe 1 as viewed in a width direction, that is, on the drive shaft section 23*a* side of the drive shaft 23 as shown in FIG. 11 can be swung with the same phase and the paired separation pieces 11 in the other array can have its swing phase controlled relative to the paired separation pieces 11 on the one array side.

Further, the swinging movements of the paired separation pieces 11 in the two arrays are such that one adjacent end of one paired separation pieces is moved downward while, on the other hand, the adjacent end of the other paired separation pieces is moved upward as shown in FIG. 11. Even in this case, the user can enjoy different motion from that in the first embodiment.

Figure 12:
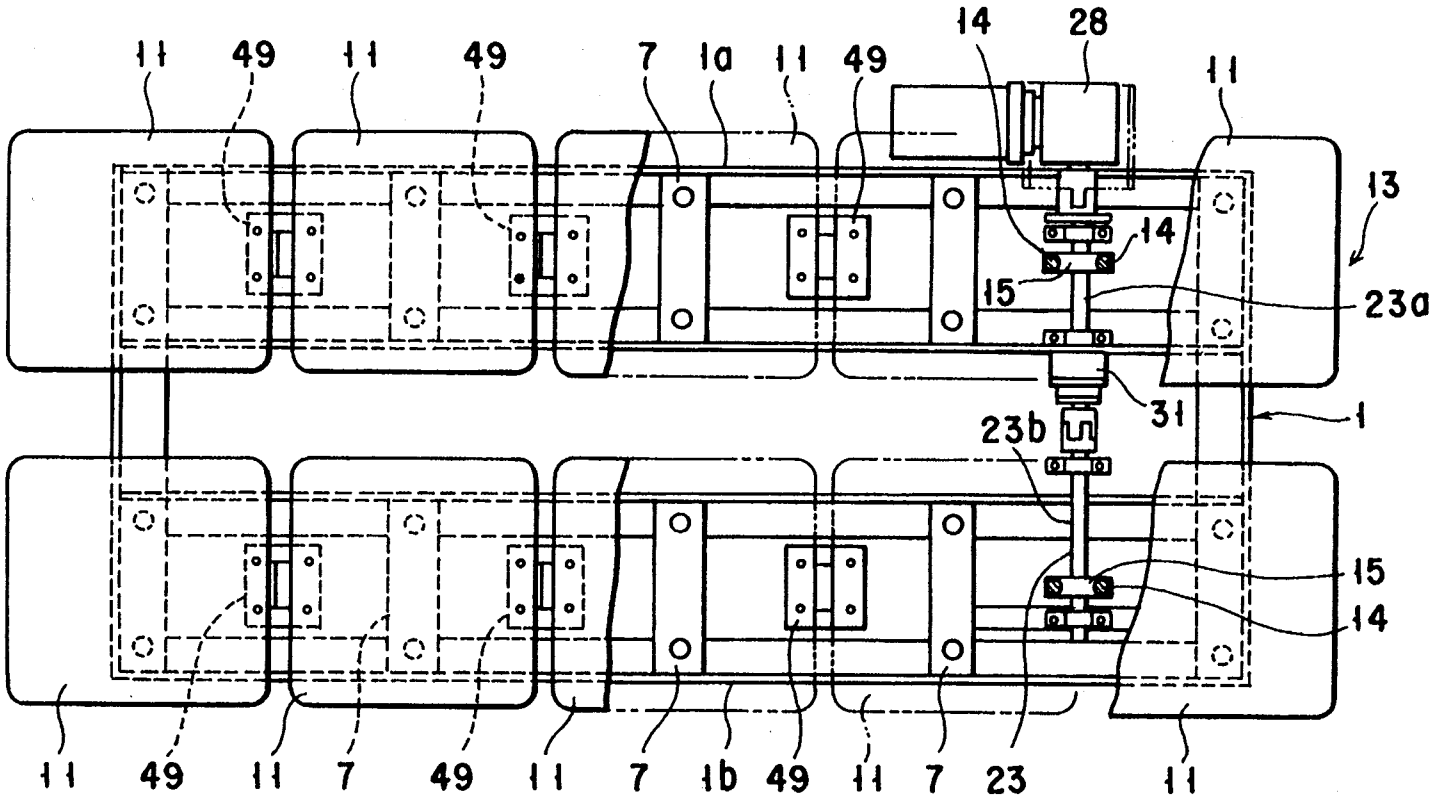
FIG. 12 is a plan view showing a bed apparatus according to a third embodiment of the present invention.
Figure 13:
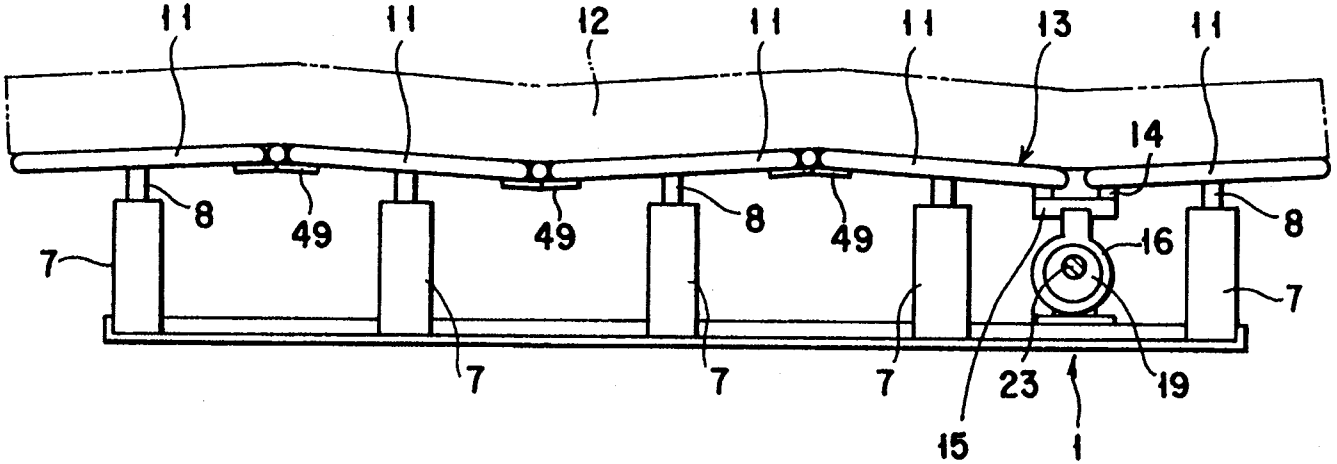
FIG. 13 is a side view showing the bed apparatus of FIG. 12.

FIGS. 12 and 13 show a third embodiment of the present invention. In this embodiment a rectangular bedframe 1 has a frame section 1*a* on one side and frame section 1*b* on the other side as viewed in a width direction of the bedframe 1. A plurality of support members are uprightly arranged at a predetermined interval on the respective frame sections 1*a* and 1*b* along the length of the bedframe and, each, are comprised of a gate-like support member formed of a bent band-like member.

Separation pieces 11 constituting a bedstead 13 are provided on the respective support members 7. To be specific, 10 separation pieces 11 are arranged in two 5-successive units along the length of the bedframe, i.e., in two parallel arrays as viewed across the width of the bedframe. The respective separation pieces 11 are swingably coupled by coupling members 8 to, and supported on, the upper surfaces of the respective support members 7.

Of those 5 successive separation pieces 11, 4 successive separation pieces 11 except one arranged on one side of the bedframe 1 are bendably coupled by hinges 49 at their mutual adjacent end portions to each other.

The respective one-end portions of a corresponding coupling member 14 are coupled to the lower surfaces of the corresponding end portions of the separation piece 11 on the one-end side of the bedframe 1 and adjacent separation piece 11. The other end of the coupling member 14 is coupled to a coupling tool 15 mounted on the upper end of a movable arm 16.

As in the first embodiment, one of a pair of movable arms 16 is driven in up/down motion through a disk 19 which is eccentrically rotated by a drive shaft section 23*a* of a drive shaft 23. The other movable arm 16 is mounted on a driven shaft section 23*b*.

According to the bed apparatus thus arranged, if the user operates a drive source 28 in a lying-on-the-back position on a mattress 12 to cause the two serially-arranged separation piece groups, right and left, to be moved in the same swing phase, then the respective separation pieces in the right and left separation piece groups are bendable in a serpentine curve including a plurality of crests and troughs as shown in FIG. 13 so that the body of the user experience the bending movements on the mattress. Therefore, the user can do slimming exercise on the mattress for health so that any excess fat can be removed from his or her body.

If the separation pieces 11 in the two serially-arranged separation piece groups, right and left, are moved by an electromagnetic clutch 31 with a swing phase of, for example, 90°, the right and left separation pieces 11 produce a bend phase shift in an up and down motion so that the user experiences right/left twisting motion on the mattress. The extent of twisting on the right and left separation pieces 11 is adjusted in a phase shift range of 0° to 180° where there is no twist for 0° and a maximum twist for 180°.

Since the right and left separation pieces 11 are bent in a phase shift fashion, the user experiences right/left twisting motions on the mattress while being bent at four places corresponding to the number of coupled areas of the separation pieces 11. The user can get more effective slimming exercise than in the case where there is only one bend area.

Figure 14:
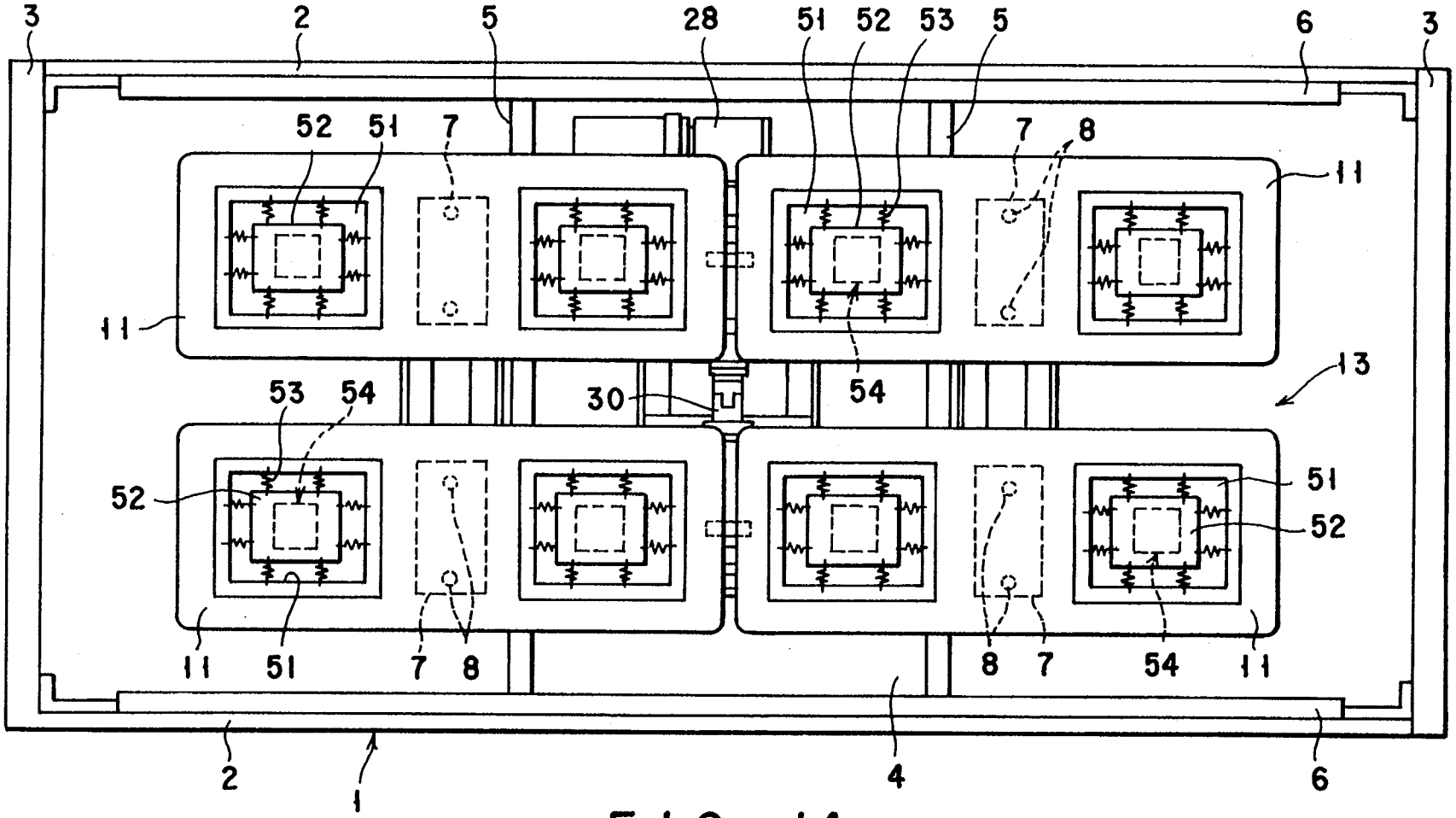
FIG. 14 is a plan view showing a bed apparatus according to a fourth embodiment of the present invention.
Figure 16:
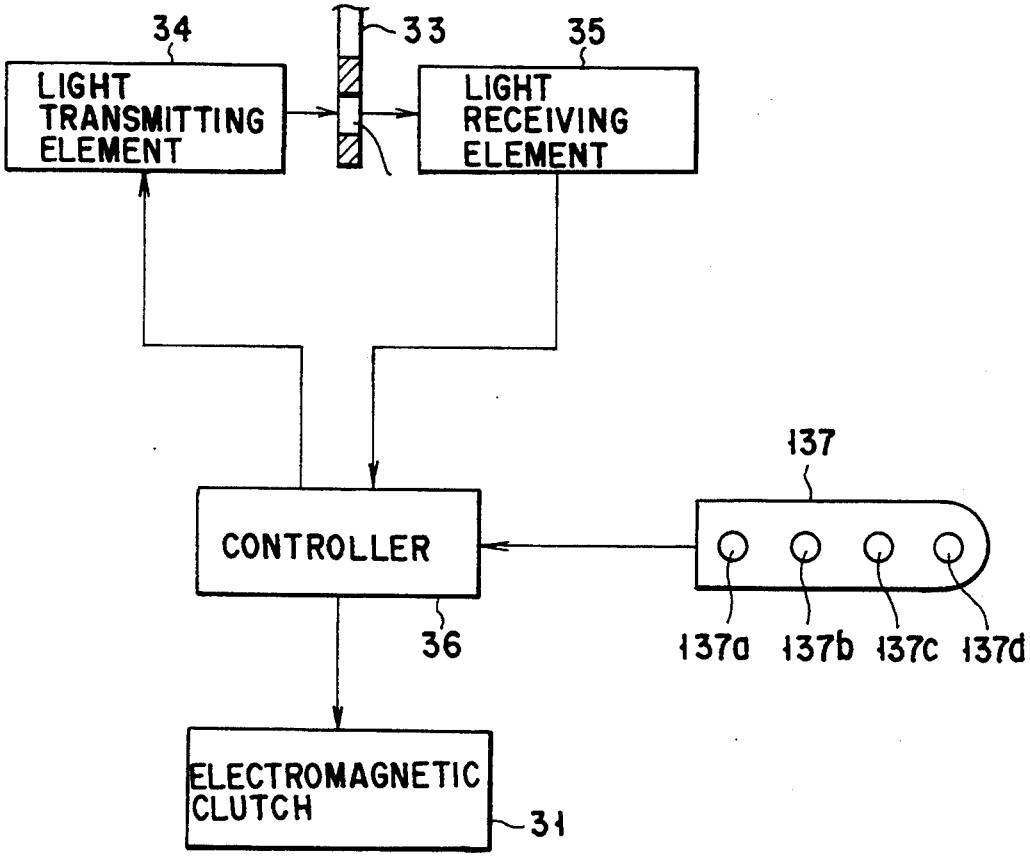
FIG. 16 shows a control circuit for the fourth embodiment.

FIGS. 14 and 16 show a fourth embodiment of the present invention. This embodiment is similar to the first embodiment, but is different from the latter embodiment in that a vibration generation device is provided in each of separation pieces. To put it more specifically, the respective separation piece 11 has a pair of rectangular openings 51 along its length. A rectangular vibration plate 52 is held in each opening 51 and is smaller than the opening 51.

Frame members 51*a* and 52*a* are mounted on the inner wall surface of the opening 51 and outer peripheral surface of the vibration plate 52. A pair of hooks 50 are projected from the corresponding portions of the respective frame members 51*a*, 52*a*. A coil spring 53 is stretched between the hooks of the opposed frames 51*a* and 52*a* so that each vibration plate 52 is so held as to be elastically displaceable in the opening 51.

A vibrator 54 is mounted on the lower surface of each vibration plate 52 and comprises a casing 55, motor 56 held within the casing 56 and weight 57 eccentrically rotated by the motor. These members 55, 56 and 57, together with the vibration plate 52, constitute the vibration generation device as set out above.

Figure 15:
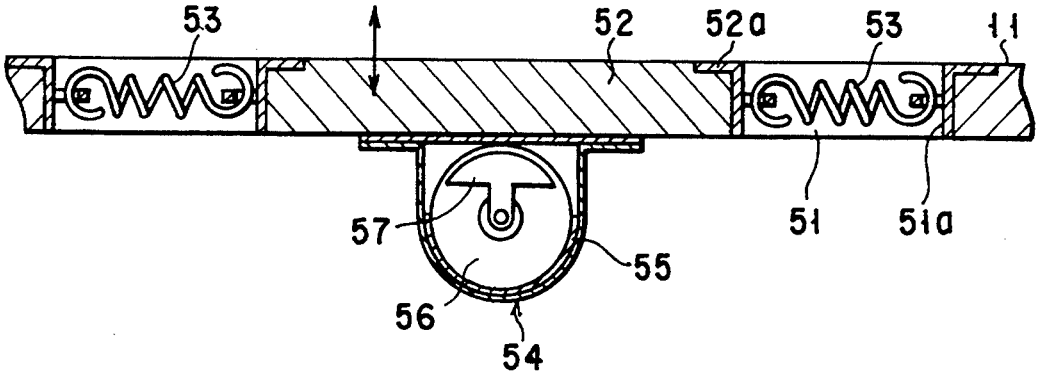
FIG. 15 is an enlarged cross-sectional view showing the fourth embodiment.

The weight 57, being eccentrically rotated by the motor 56, produces vibration and hence the vibration plate 52 is moved in an up/down direction as indicated by arrows in FIG. 15. With the vibration plate 52 vibrated in the up and down direction, corresponding vibration is transmitted to the user's body through a mattress 11 on a bedstead 13, thus giving a massaging effect to the user.

The user side's operation section 137 in the fourth embodiment includes a power source switch 137*a*, first operation switch 137*b*, second operation switch 137*c* and speed control switch 137*d* as shown in FIG. 16, noting that the first operation switch 137*b* is provided for controlling a current in an electromagnetic switch 31 and second operation switch 137*c* is provided for turning the vibrator ON and OFF.

According to the bed apparatus thus arranged, paired separation pieces 11, right and left, in two arrays, upon being bent, impart motion to the user on the mattress as well as vibratory massage produced through the vibration of the vibration plate 52 by the vibrator 54.

Figure 17:
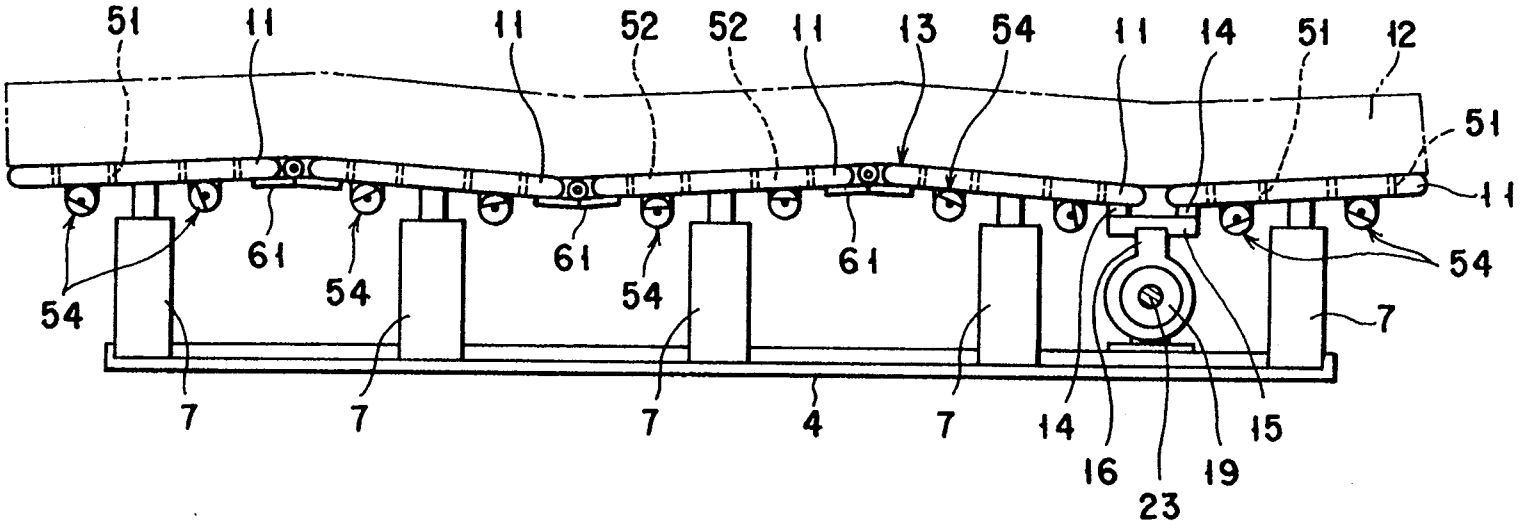
FIG. 17 is a side view showing a bed apparatus according to a fifth embodiment of the present invention.

FIG. 17 shows a fifth embodiment of the present invention. The fifth embodiment is of such a type that, in the bed apparatus shown in the third embodiment, a pair of openings 51 are provided in a respective one of separation pieces 11 in a bedstead 13 as shown in the fourth embodiment with a vibration plate 52 elastically displaceably held in the corresponding opening 51 and a vibrator 52 is provided on the lower surface side of the vibration plate 52.

Figure 18:
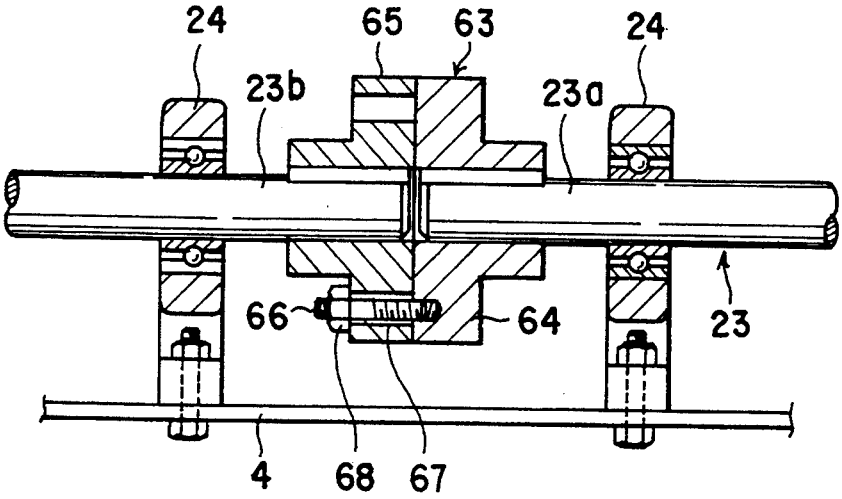
FIG. 18 is a cross-sectional view showing a drive mechanism for controlling the swing motion phase of separation pieces in a sixth embodiment of the present invention.
Figure 19:
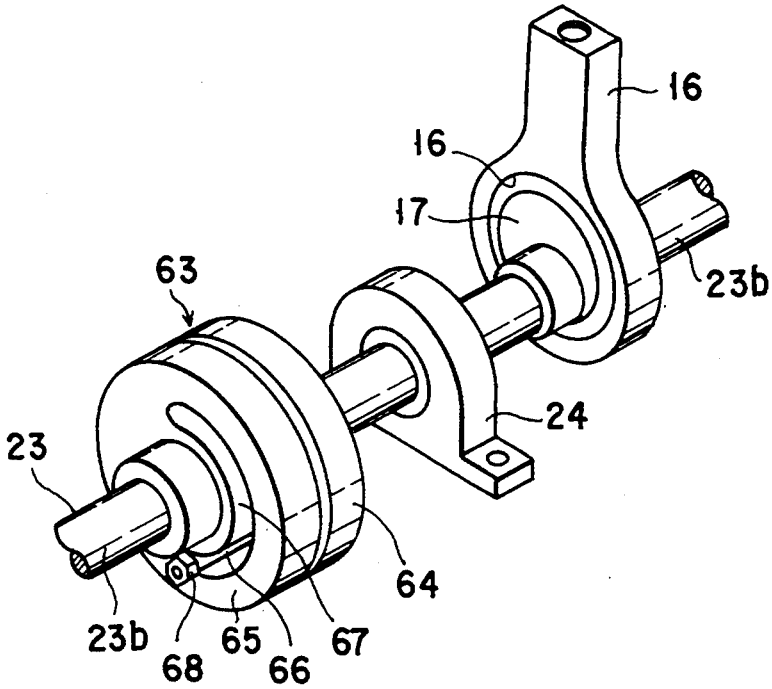
FIG. 19 is a perspective view showing the drive mechanism of FIG. 18.

FIGS. 18 and 19 show a sixth embodiment of the present invention. In the sixth embodiment, a drive shaft section 23*a* and driven shaft section 23*b* of a drive shaft 23 are connected together by a coupling 63, not an electromagnetic clutch 31. The coupler 63 comprises a first coupling disk 64 fixedly fitted over the end portion of the drive shaft section 23*a* and second coupling disk 65 fixedly fitted over the end portion of the driven section 23*b*.

A threaded shaft 66 is fixed to the first coupling disk 64 and projected as shown in FIG. 18. The second coupling disk 65 has an elongated hole 67 which is circumferentially provided therein to an extent of substantially 180°. The threaded shaft 66 is inserted through the elongated hole 67 with a nut 68 fitted over the projecting end portion of the threaded shaft 66. Due to the coupling disks 64 and 65 coupled together, the driven shaft section 23*b* can be moved in interlock with the rotation of the drive shaft section 23*a*.

The driven shaft section 23*b* is fixed to the drive shaft section 23*a* at a given rotation angle by making the second coupling disk 65 rotatable relative to the first coupling disk 64 with the nut 68 loosened, rotating the second coupling disk 65 to an extent that the elongated hole 67 allows the threaded shaft 66 to be slidably rotated therein and tightening the nut 68 to fix the first coupling disk 64 to the second coupling disk 65.

Since, with the use of the coupler 63 as set out above, the rotation angle the driven shaft section 23*b* is made relative to the drive shaft section 23*a* can be arbitrarily set in a rotation angle phase of 0° to 180°, it is possible to arbitrarily set the swing phases of the separation pieces 11 in the bedstead 13 swingably driven by the drive shaft section 23*a* and separation pieces 11 in the bedstead swingably driven by the driven shaft section 23*b*.

Figure 20:
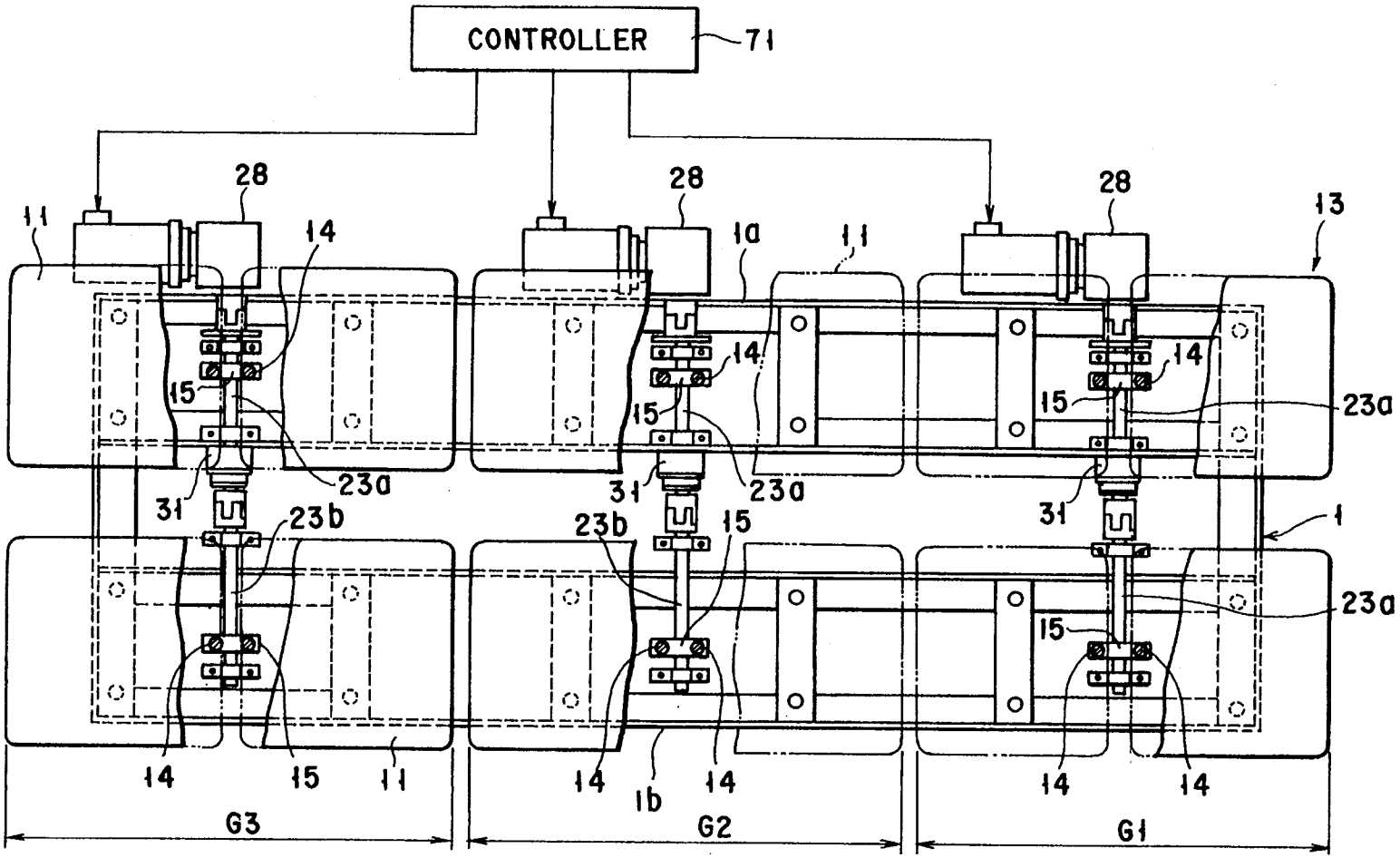
FIG. 20 is a plan view showing a bed apparatus according to a seventh embodiment of the present invention.
Figure 21:
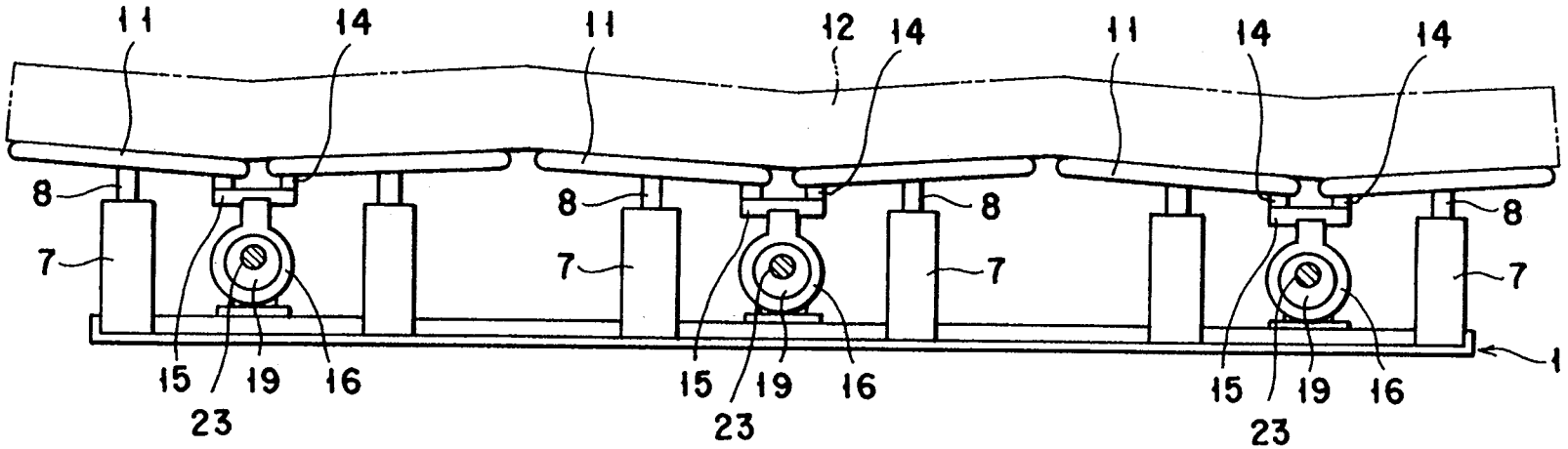
FIG. 21 is a side view showing the seventh embodiment.

FIGS. 20 and 21 show a seventh embodiment of the present invention. In this embodiment, a plurality (12 in this embodiment) of separation pieces 11 are arranged widthwise in two arrays along a length of a bedframe 1. The sixth separation pieces in each array are swingably mounted by a coupling member 8 on the upper end surface of a support member 7.

The separation pieces 11 arranged in the two arrays as viewed in a width direction of the bedframe 1 are grouped into three groups G1, G2 and G3 in the longitudinal direction of the bedframe 1 as shown in FIG. 20 with two separation pieces 11 as each group.

The separation pieces 11 in each group are swingably driven by a corresponding separate drive mechanism such that their adjacent ends are coupled to a coupling tool 15 through a coupling member 14. The coupling tool 15 is attached to the upper end surface of a movable arm 16. A disk 19 is rotatably mounted on the movable arm 16 and eccentrically rotated by a drive shaft 23.

The eccentric rotation of the disk 19 causes the movable arm 16 to be moved in up/down motion so that the paired separation pieces 11 in each group have their opposed ends moved in push/pull motion, e.g., in up/-down motion due to the presence of the coupling tool 15. As a result, the paired separation pieces 11 are swingable, along the length of the bedframe 1, about an area connected to the upper surface of the support member 7 through the coupling member 8.

Three drive source sources 28 and electromagnetic clutches 31 in a drive mechanism for driving the separation pieces in each group are controlled by a controller 71. The arranged separation pieces 11 in the respective groups G1, G2 and G3 have their swing phase set under control of the electromagnetic clutch 31. The drive source 28 can be controlled by the controller 71 in a rotation speed of the drive shaft 23 and in a swing motion phase for each group of the separation pieces.

Thus the user can enjoy varying slimming exercise because the swing motion phase and speed can be controlled for each group of the separation pieces 11.

Figure 22:
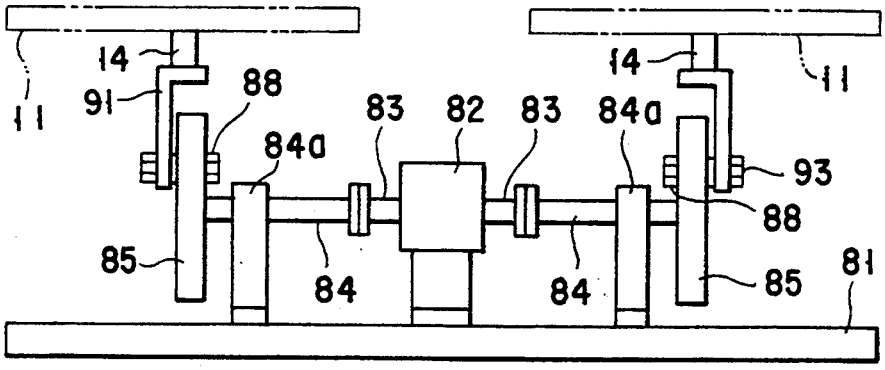
FIG. 22 is a side view showing a bed apparatus, along a width direction, according to an eighth embodiment of the present invention.

FIGS. 22 to 25 show an eighth embodiment of the present invention. This embodiment can control a swing angle in the swing motion of the separation pieces 11. FIG. 22 is a diagrammatic arrangement of the eighth embodiment where reference numeral 81 shows a bedframe. At the middle of width of the bedframe 81 a twin-shaft motor 82 is so arranged that a pair of drive shafts 83 extend along the width of the bedframe 81, in a direction away from the motor.

Figure 23:
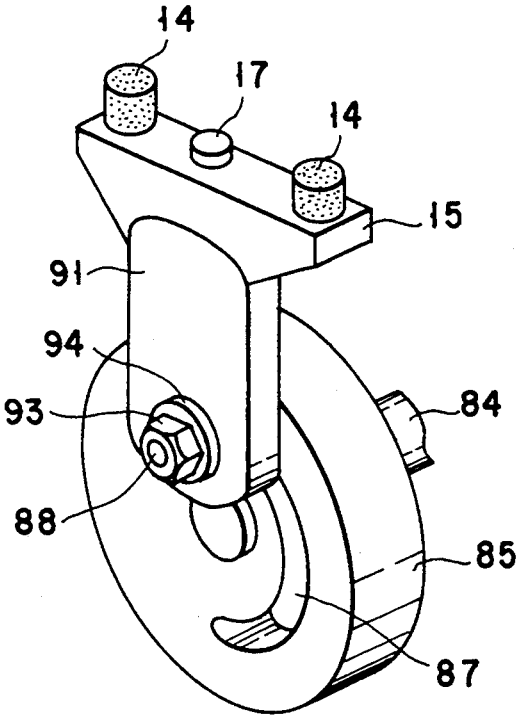
FIG. 23 is a perspective view showing a rotation disk and arm of the eighth embodiment.
Figure 24:
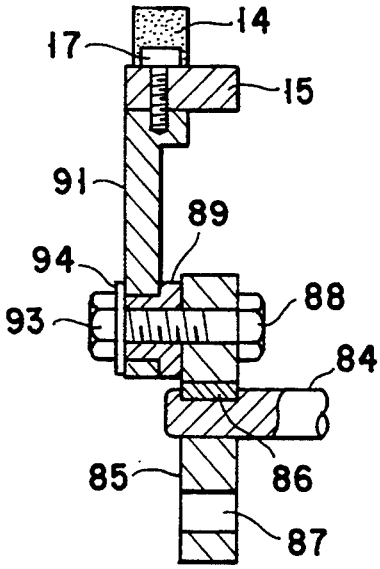
FIG. 24 is a cross-sectional view showing the rotation disk and arm of FIG. 23.
Figure 25:
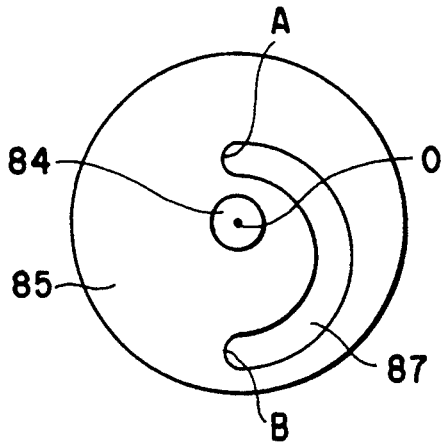
FIG. 25 is a side view showing the rotation disk of FIG. 24.

A pair of rotation shafts 84, 84 are connected at one end to the corresponding drive shafts 83 of the motor 82. The other end of the respective rotation shaft 84 is rotatably journalled in a corresponding bearing 84*a*. The end of the respective rotation shaft 84 which extends out of a corresponding bearing 84*a* is integrally coupled by a key 86 to the center area of a rotation disk 85 as shown in FIG. 24. An arcuate elongated hole 87 is provided in the rotation disk 85 as shown in FIGS. 23 and 25 and extends from one end A to the other end B in a gradually increasing distance from the center axis O of the rotation shaft 84 as shown in FIG. 25, that is, a gradually increasing radius is defined from the end A to the end B of the elongated hole with the center axis O of the rotation shaft 84 as shown in FIG. 25.

A bolt 88 is inserted from one side surface side of the rotation disk 85 and extends out of the other end surface side of the rotation disk 85 as shown in FIG. 24. A stepped bush 89 is fitted over the portion of the bolt 88 extending out of the other surface side of the rotation disk 85. An arm 91 has a mount hole 92 as its lower end portion and is rotatably inserted over the bush 89 via the mount hole 92. A nut 93 is threaded, via a washer 94, over the end portion of the bolt 88 extending out of the bush 89, thereby preventing the arm 91 from dropping off the bush 89. With the nut 93 tightened the bolt 88 is fixed to the rotation disk 85 through the bush 89.

As in the first embodiment, a long coupling tool 15 of the bedframe 81 is mounted on the upper end surface of the arm 91 and a pair of coupling members 14 are provided on the upper surface of the arm in a longitudinally spaced-apart relation. As in the case of the coupling member 14 in the first embodiment, the coupling member 14 is made of an elastic material and the ends of separation pieces 11 are connected to the corresponding coupling members 91.

According to the eighth embodiment thus arranged, with the rotation disk 85 rotated, the arm 91 can be moved in up/down motion in accordance with an amount of eccentric movement corresponding to the fixed position of the bolt 88 in the arcuate elongated hole 87. With the arm 91 moved in the up and down direction the corresponding pair of separation pieces 11 have their end portions moved in up/down motion, i.e., in a push/pull motion, due to the separation pieces 11 coupled to the upper end surface of the arm 91 by the coupling member 14. It is, therefore, possible to swingably drive the ends of the separation pieces 11.

The amount of eccentric movement of the arm 91 relative to the rotation disk 85 can be made variable by, with the nut 93 loosened, moving the bolt 88 along the elongated hole 87 in the rotation disk 85 and tightening the nut 93 in a given position so as to fix the bush 89 in place. The amount of eccentric movement (an up and down motion stroke) of the arm 91, being varied, can vary the swing angle of the separation pieces 11 coupled to the arm 91, that is, it is possible to set the swinging movement of the separation pieces 11 to a given proper extent.

The arm 91 is moved in an up and down motion due to the swinging movement of the rotation disk 85 and in rotation motion due to the aforementioned increasing radius extending relative to the center axis of the rotation disk 85 with the bolt 88 coupled thereto. However, the swinging movement is absorbed due to the bending of the coupling members 14 whereby the arm 91 is coupled to the corresponding separation pieces 11, noting that the coupling member is made of elastic material. For this reason, no great stress is applied to the separation pieces 11 due to the rotation of the arm 91.

Figure 26:
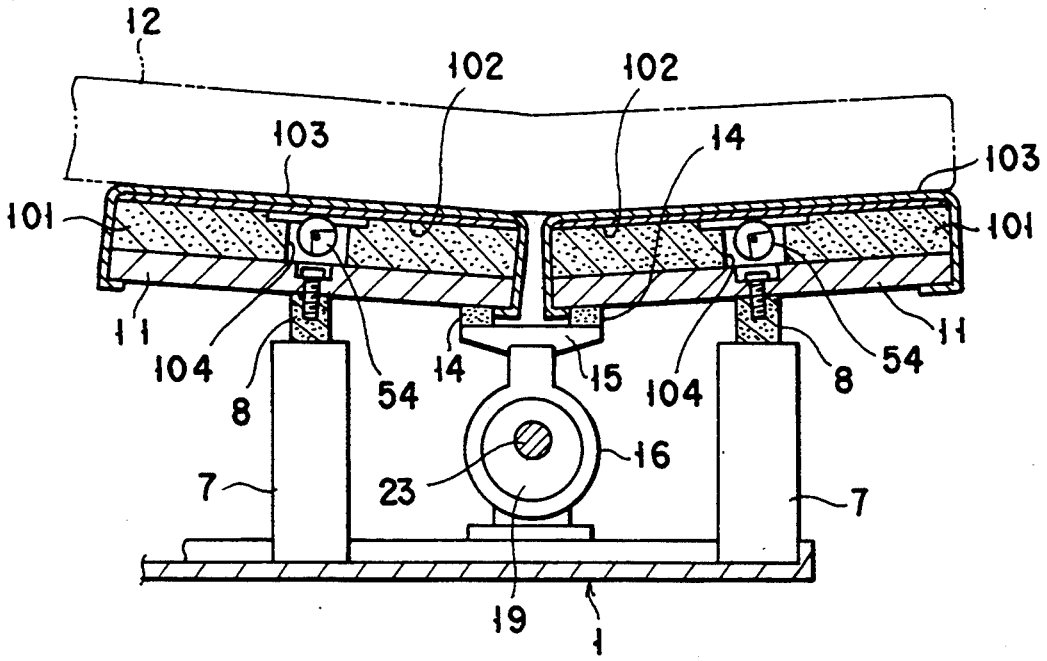
FIG. 26 is a cross-sectional view, as taken along a longitudinal direction, showing a bed apparatus according to a ninth embodiment of the present invention.

FIG. 26 shows a ninth embodiment of the present invention. This is a modified structure where a vibrator 54 as shown in the fourth embodiment of FIGS. 14 to 16 is provided at the separation piece 11. To be specific, with the ninth embodiment an elastic sheet 101 such as urethane foam is joined to the upper surface of the separation pieces 11. A vibration transmitting plate 102 made of thin, relatively hard wood or synthetic resin is joined to the upper surface of the elastic sheet 101 and covered with a cover 103.

A receiving hole 104 is provided in the elastic sheet 101. The aforementioned vibrator 54 is mounted on the lower surface of the vibration transmitting plate 102 and dropped in the receiving hole 104.

With the vibrator 54 operated the vibration transmitting plate 102 is vibrated while elastically deforming the elastic sheet 101. As a result, a massaging effect can be imparted to the user on the mattress 12. In this embodiment the user can enjoy slimming exercise over the covered elastic sheet without the use of a mattress 12.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A bed apparatus comprising:

a bedframe;

a bedstead comprising a plurality of separation pieces that are divided in a longitudinal direction of the bedframe such that said separation pieces are arranged in two arrays in a width direction of the bedframe so that separation pieces of each array are adjacent to each other and are spaced apart from each other;

a plurality of coupling means for rotatably coupling adjacent end portions of a separation piece in each array to each other so that the two arrays are coupled to each other via said coupling means;

a drive shaft divided into a plurality of drive shaft sections coupled to drive one of said arrays of separation pieces and a plurality of driven shaft sections coupled to drive the other array of separation pieces such that said plurality of drive shaft sections and said plurality of driven shaft sections are rotatable in the width direction of the bed frame;

drive means for rotatably driving said plurality of drive shaft sections of said drive shaft;

power transmission means comprising:

a plurality of circular disks, each circular disk being mounted to be eccentrically rotatable on each of said plurality of drive shaft sections and each of said plurality of driven shaft sections; and a plurality of movable arms respectively having first and second end portions, each movable arm having said first end portion thereof rotatably coupled to a respective one of said plurality of circular disks to enable each of said plurality of movable arms to be moved in an up and down direction by an eccentric rotation of said respective one of said plurality of circular disks, and said second end portion of each movable arm being coupled to a respective one of said plurality of coupling means coupling adjacent end portions of said separation pieces to each other; and phase control means for coupling an end portion of each of said plurality of drive shaft sections to an end portion of a respective one of said plurality of driven shaft sections of the drive shaft and for setting a circumferential coupling angle between said plurality of drive shaft sections and said plurality of driven shaft sections to thereby selectively control a phase of a swinging motion of the separation pieces in one array that are driven by said plurality of drive shaft sections relative to said plurality of separation pieces in the other array that are driven by said plurality of driver shaft sections.

2. An apparatus according to claim 1, wherein each separation piece has a longitudinal intermediate area, the longitudinal intermediate area of each separation piece being swingably attached by an elastic member to one of a plurality of support members, each support member being mounted on said bedframe to be in an upright, longitudinal direction of said support member.

3. The apparatus according to claim 1, wherein said power transmission means is settable by a user to set a length of a stroke in said up and down direction of each of said plurality of movable arms and wherein the up and down motion of each of said plurality of movable arms is transmitted to the bedstead.

4. The apparatus according to claim 1, wherein at least one of said plurality of separation pieces is coupled to a vibrator for producing vibrations.

5. The apparatus according to claim 4, wherein said vibrator is mounted on a lower surface side of a vibration transmitting plate that overlays said at least one of said plurality of separation pieces, and further comprising an elastic sheet provided between said at least one separation piece and said vibration transmitting plate.

6. The apparatus according to claim 5, wherein:

an opening is provided in said at least one separation piece;

said vibration transmitting plate is elastically displaceably mounted in said opening provided in said one separation piece; and said vibrator is provided on a lower surface side of said vibration transmitting plate to vibrate said vibration transmitting plate.

7. An apparatus according to claim 1, wherein said phase control means includes means for controlling a swing phase of said separation pieces in each of said two arrays.

8. An apparatus according to claim 1, wherein said phase control means includes means for controlling a speed with which separation pieces in each of said two arrays are swung.

9. A bed apparatus comprising:

a bedframe;

a bedstead comprising a plurality of separation pieces that are divided in a longitudinal direction of the bedframe such that said separation pieces are arranged in two arrays in a width direction of the bedframe so that separation pieces of each array are adjacent to each other and are spaced apart from each other;

a plurality of coupling means for rotatably coupling adjacent end portions of a separation piece in each array to each other so that the two arrays are coupled to each other via said coupling means;

a drive shaft divided into a plurality of drive shaft sections coupled to drive one of said arrays of separation pieces and a plurality of driven shaft sections coupled to drive the other array of separation pieces such that said plurality of drive shaft sections and said plurality of driven shaft sections are rotatable in the width direction of the bed frame;

drive means for rotatably driving said plurality of drive shaft sections of said drive shaft;

power transmission means comprising:

a plurality of circular disks, each circular disk being mounted to be eccentrically rotatable on each of said plurality of drive shaft sections and each of said plurality of driven shaft sections; and a plurality of movable arms respectively having first and second end portions, each movable arm having said first end portion thereof rotatably coupled to a respective one of said plurality of circular disks to enable each of said plurality of movable arms to be moved in an up and down direction by an eccentric rotation of said respective one of said plurality of circular disks, and said second end portion of each movable arm being coupled to a respective one of said plurality of coupling means coupling adjacent end portions of said separation pieces to each other; and phase control means for coupling an end portion of each of said plurality of drive shaft sections to an end portion of a respective one of said plurality of driven shaft sections of the drive shaft and for setting a circumferential coupling angle between said plurality of drive shaft sections and said plurality of driven shaft sections to thereby selectively control a phase of a swinging motion of the separation pieces in one array that are driven by said plurality of drive shaft sections relative to said plurality of separation pieces in the other array that are driven by said plurality of driver shaft sections.

and wherein:

said phase control means comprises:

an electromagnetic clutch provided between said plurality of drive shaft sections and said plurality of driven shaft sections of said drive shaft to enable said plurality of drive shaft sections and said plurality of driven shaft sections to be coupled to and decoupled from each other;

a detector for detecting a rotation angle of said plurality of drive shaft sections and for providing a detection signal responsive to said detected rotation angle; and control means for controlling a transmission to said electromagnetic clutch of said detection signal from said detector and for setting a rotation phase angle between said plurality of driven shaft sections and said plurality of drive shaft sections when said plurality of driven shaft sections are coupled to said plurality of drive shaft sections said the electromagnetic clutch; and wherein the detector comprises:

a slip plate having a circumference, said slip plate including a plurality of throughbores provided at a given interval along a circumferential direction thereof, said slip plate being rotatable as one unit with one of said plurality of drive shaft sections; and a sensor for detecting said throughbores in said slip plate.

10. An apparatus according to claim 9, wherein each of said separation pieces has a longitudinal intermediate area, said longitudinal intermediate area of each separation piece being swingably attached by an elastic member to one of a plurality of support members, each support member being mounted on said bedframe in an upright longitudinal direction of said support member.

11. The apparatus according to claim 9, wherein said power transmission means is settable by a user to set a length of a stroke in the up and down direction of each of said plurality of movable arms and wherein up and down stroke of each of said plurality of movable arms is transmitted to said bedstead.

12. The apparatus according to claim 9, wherein said control means comprises:

a coupler comprising:

a first coupling disk coupled to one of said plurality of drive shaft sections;

a second coupling disk coupled to one of said plurality of driven shaft sections; and a coupling device for fixedly coupling said second coupling disk to said first coupling disk at a given angle.

13. The apparatus according to claim 9, wherein at least one of said plurality of separation pieces is coupled to a vibrator for producing vibrations.

14. The apparatus according to claim 13, wherein said vibrator is mounted on a lower surface side of a vibration transmitting plate that overlays said at least one of said plurality of separation plates, and further comprising:

an elastic sheet provided between said at least one separation piece and said vibration transmitting plate.

15. The apparatus according to claim 13, wherein:

an opening is provided in said at least one separation piece;

said vibration plate is elastically displaceably mounted in said opening provided in said at least one separation piece; and said vibrator is provided on a lower surface side of said vibration transmitting plate to vibrate said vibration transmitting plate.

16. An apparatus according to claim 9, wherein said phase control means includes means for controlling a swing phase of separation pieces in each of said two arrays.

17. An apparatus according to claim 9, wherein said phase control means includes means for controlling a speed with which separation pieces in each of said two arrays are swung.

* * * * *